United States Patent [19]

Cullen et al.

[11] 4,017,113

[45] Apr. 12, 1977

[54] ELECTRICAL CABLE OVERSHOT-GRAPPLING TOOL

[75] Inventors: Roy H. Cullen; Jimmie R. Aker; Jim Witovek, Jr., all of Houston, Tex.

[73] Assignee: General Electric Company

[22] Filed: Feb. 4, 1976

[21] Appl. No.: 654,992

[52] U.S. Cl. ..... 294/86.22; 294/86.28; 294/86.33

[51] Int. Cl.[2] ..... E21B 31/12

[58] Field of Search ..... 294/86.1, 86.14, 86.17, 294/86.18, 86.22, 86.26–86.34, 99 R, 100, 116, 90; 24/263 DF; 166/98, 99

[56] References Cited

UNITED STATES PATENTS

| | | | |
|---|---|---|---|
| 714,989 | 12/1902 | Worthington | 294/86.14 |
| 1,208,846 | 12/1916 | Sheldon et al. | 294/86.28 |
| 1,456,943 | 5/1923 | Smith | 294/86.28 |
| 1,611,923 | 12/1926 | Leonard | 294/100 X |
| 1,761,463 | 6/1930 | Beckett | 294/86.22 |
| 2,709,617 | 5/1955 | Lang | 294/86.14 X |
| 3,727,967 | 4/1973 | Anastasiu et al. | 294/86.31 |

FOREIGN PATENTS OR APPLICATIONS

| | | | |
|---|---|---|---|
| 33,458 | 9/1907 | Austria | 294/86.22 |

*Primary Examiner*—Johnny D. Cherry
*Attorney, Agent, or Firm*—Pravel, Wilson & Gambrell

[57] ABSTRACT

An overshot-grappling tool adapted to be lowered, raised and manipulated to retrieve sections of electrical cable from a well, wherein a plurality of flexible gripping fingers are provided for gripping a termianl connector of the electrical cable section along with releasable means to restrain the gripping fingers under spring pressure for such gripping action and to release the fingers from the terminal connector.

9 Claims, 3 Drawing Figures

W
F
12c
12h
20
12g
12f
12b
12
12a
12e
12d
18d
18e
18
18a
14a
14b
14c
18h
18f
16
18b
19
24c
23c
24b
24a
23b
23a
18c
18g
22c
22b
21a
21c
21b
22a
C1
C2
C
18i
C-3
C-4

ELECTRICAL CABLE OVERSHOT-GRAPPLING TOOL

BACKGROUND OF THE INVENTION

The field of this invention is overshot-grappling tools for retrieving objects from a well.

Various tools for fishing objects from a well have been known and used in the past, examples of which are shown in U.S. Pat. Nos. 1,732,563; 1,750,728; 1,761,463; 2,280,422; 2,508,422; 2,605,131; 2,562,281; 2,872,238; 2,908,925; 3,191,981; and 3,758,145. Such tools are usually designed and employed for retrieving specific types of objects in the well, such as wire lines, tubing, tools, junk, and the like under specific circumstances. However, so far as is known, no satisfactory fishing tool has been provided for retrieving complete lengths of electrical cable sections.

SUMMARY OF THE INVENTION

The present invention relates to a new and improved overshot-grappling fishing tool for retrieving sections of electrical cable from a well, wherein a main body member having a bore adapted to receive an electrical cable terminal connector is provided with a plurality of flexible gripping fingers for gripping the terminal connector upon receipt in the bore. Releasable means is also provided for restraining the fingers to develop a gripping force to hold the terminal connector during retrieval and for releasing the fingers from the connector after retrieval.

DESCRIPTION OF THE PREFERRED EMBODIMENTS

Figures 1, 2, 3:
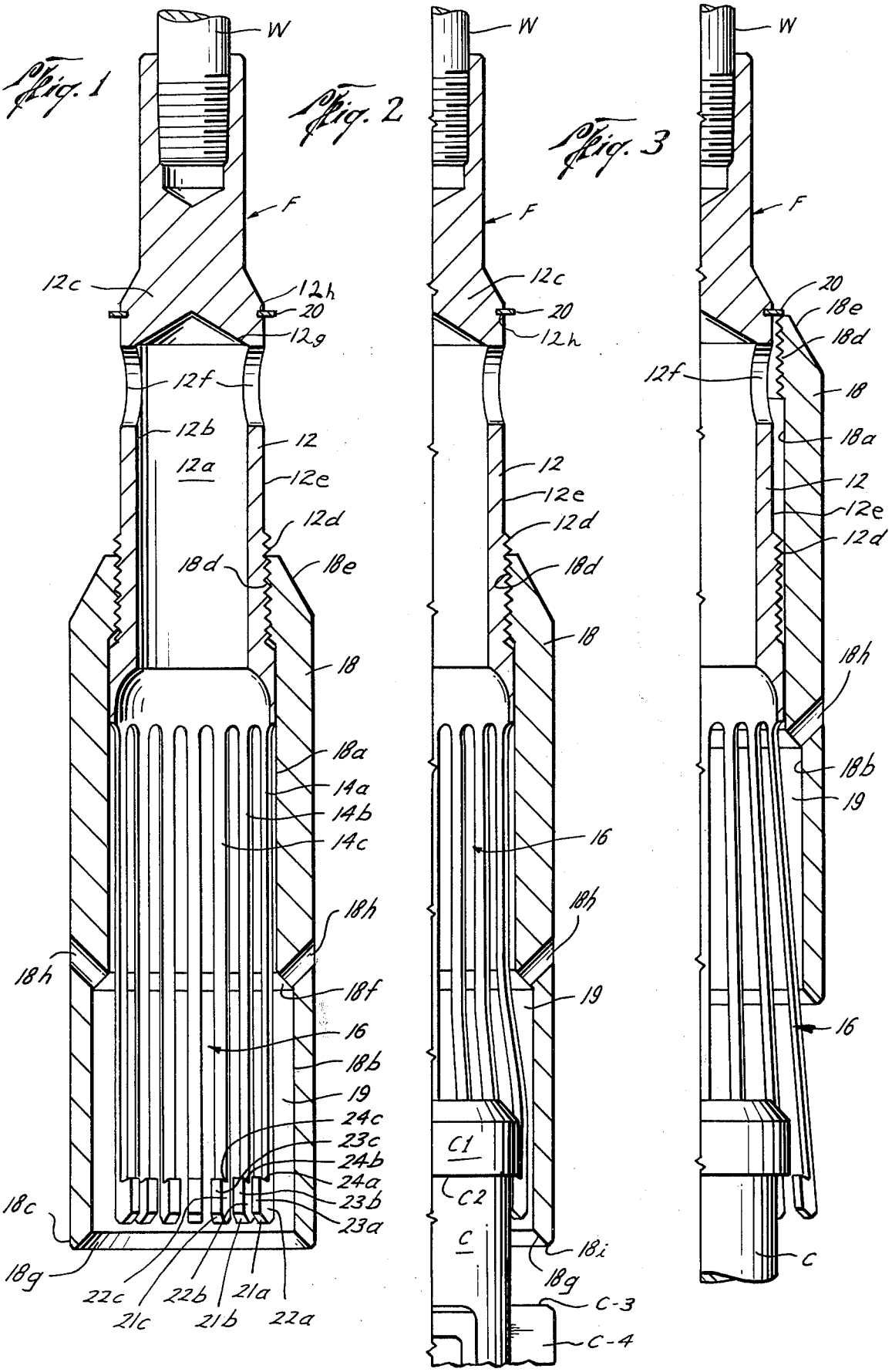
FIG. 1 is a vertical sectional view illustrating the overshot-grappling tool of this invention with the tool outer tubular body in position for forcibly retaining the flexible gripping fingers in position for gripping an electrical cable terminal connector in a well.
FIG. 2 is a fragmented view similar to FIG. 1, but illustrating the tool after it has contacted and received the electrical cable terminal connector between the flexible gripping fingers wherein the terminal connector is gripped by the gripping fingers and is ready for retrieval from the well.
FIG. 3 is a fragmented view similar to FIGS. 1 and 2, but illustrating the positioning of the outer tubular body and gripping fingers for releasing the cable terminal connector from gripping contact with the tool after the cable has been retrieved.

The overshot or fishing tool of the present invention is particularly employed for retrieving sections of electrical cable disposed in a well which have substantially rigid terminal connectors provided at the ends of each cable section. Such terminal connectors are preferably of a size and shape which permits the fishing tool of this invention to be lowered over same for gripping thereof. Examples of such types of electrical cable terminal connectors are described in copending patent application Ser. No. 448,975, filed on Mar. 7, 1974, now U.S. Pat. No. 3,926,269.

In the drawings, the letter F designates generally the overshot or fishing tool of this invention which is adapted to be lowered on a wire line W into a well pipe or the like in a well for the purpose of gripping a terminal connector C of an electrical cable disposed in the well and retrieving same therefrom. With the present invention, an operator at the surface may manipulate the wire line W so as to grip the terminal connector C and retrieve the electrical cable from the well with relative ease, as will be more fully explained.

Considering the invention in more detail, the fishing tool F of the present invention includes a main body member 12 which has a truncated longitudinal bore **12*a* formed therein defined by a main body inner wall 12*b* and upper end wall 12*c*. The main body 12 also is provided with a plurality of spaced longitudinally extending felxible gripping fingers 14*a*, 14*b*, 14*c*, etc. The plurality of flexible gripping fingers 14*a*, 14*b*, 14*c* are circumferentially mounted with the main body 12 and thus, form a space 16 therebetween which is coextensive with and forms a portion of the longitudinal bore 12*a*. The longitudinal bore 12*a* and space 16 are adapted to receive the electrical cable terminal connector C for gripping thereof with the gripping fingers 14*a*, 14*b*, 14*c*** therebetween.

As illustrated in FIG. 3, the flexible gripping fingers **14*a*, 14*b*, 14*c* normally flare outwardly slightly in relation to their interconnection with the main body 12 and its longitudinal axis. The gripping fingers are also sufficiently flexible so as to permit them to be forced inwardly relative to each other under spring pressure to a position substantially parallel to each other and to the main body cylindrical wall 12*b*** for gripping the electrical cable terminal connector C, as more fully explained hereafter.

An outer tubular body 18, having a cylindrical inner longitudinal wall **18*a* of an inner cross-sectional diameter slightly greater than the outer cross-sectional diameter of the main body 12 is provided which is mounted concentrically about the main body 12 for longitudinal movement relative therewith. The outer tubular body 18 has a length slightly greater than the length of the flexible fingers 14*a*, 14*b*, 14*c*, etc. and is adapted for the aforesaid longitudinal movement between a position concentrically about the flexible gripping fingers 14*a*, 14*b*, 14*c*, etc. for retaining them under spring pressure inwardly relative to each other for gripping the electrical cable terminal connector C (FIG. 1), and a position somewhat above the flexible gripping fingers 14*a*, 14*b*, 14*c*, etc. to permit them to flare outwardly relative to each other so as to permit the terminal connector C to be released therefrom (FIG. 3**).

The outer tubular body 18 also has an enlarged counterbore portion **18*b* adjacent its lower open end 18*c* which extends longitudinally thereto a predetermined distance approximately half the length of the flexible gripping fingers 14*a*, 14*b*, 14*c*, etc. The enlarged counterbore 18b has a cross-sectional inner diameter greater than the cross-sectional inner diameter of the inner wall 18*a*. Thus, when the outer tubular body 18 is positioned concentrically about the gripping fingers 14*a*, 14*b*, 14*c* etc., as illustrated in FIG. 1, an annular space 19 is formed between the counterbore 18*b* and the gripping fingers 14*a*, 14*b*, 14*c*, etc. to permit the latter to be bent outwardly relative to each other under spring pressure for receiving and gripping the electrical cable terminal connector C therebetween (FIG. 2**).

The outer tubular body 18 is also provided with inwardly facing annular threads **18*d* adjacent its upper end 18*e* which are adapted for threadable connection with outwardly extending annular threads 12*d* provided with the main body outer wall 12*e* above the gripping fingers 14***a*, 14*b*, 14*c* etc. Thus, the outer tubular body 18 may be threadably connected with the main body 12 by manual rotation relative thereto to prevent relative longitudinal movement therebetween and to rigidly hold the outer tubular body 18 in the aforementioned position concentrically about the gripping fingers 14*a*, 14*b*, *14c*, etc. for forcibly retaining them under spring pressure in position for receiving and gripping the terminal connector C. Additionally, a suitable stop means such as an outwardly extending annular snap ring 20 received in an outwardly facing annular groove 12*h*, is provided with the main body 12 a desired distance from the outwardly extending threads 12*d* to prevent the outer tubular body 18 from being removed when it is threadably disconnected and moved longitudinally relative to the main body 12 (FIG. 3).

Preferably, the outer tubular body 18 also has an annular beveled portion 18*f* adjacent the upper end of the enlarged counterbore portion 18*b* to prevent the formation of excessive stress concentrations in the gripping fingers 14*a*, 14*b*, 14*c*, etc. upon bending thereof when the terminal connector C is received for gripping, as shown in FIG. 2. Further, the outer tubular body 18 has an inwardly facing tapered annular lip 18*g* at its lower end 18*c* to facilitate the positioning of the terminal connector C in the main body bore 12*b* and space 16 between the gripping fingers 14*a*, 14*b*, 14*c* etc. when the fishing tool F is lowered into the well over the connector C.

The plurality of flexible gripping fingers 14*a*, 14*b*, 14*c*, etc. are provided with an equal plurality of inwardly and upwardly facing teeth 22*a*, 22*b*, 22*c*, etc. at the outwardly extending ends thereof which are adapted to catch an outwardly extending annular fishing ring Cl provided with the electrical cable terminal connector C and retain the terminal connector C between the gripping fingers 14*a*, 14*b*, 14*c*, etc. and thus, provide additional gripping action. Each of the teeth is provided with an upwardly angled lower edge 21*a*, 21*b*, 21*c*, etc. and a substantially longitudinal inner edge 23*a*, 23*b*, 23*c*, etc. which respectively facilitate the passage of the terminal connector fishing ring Cl upwardly over the teeth 22*a*, *22b*, 22*c* as it is received within the space 16 and the bore 12*b*. Further, each of the teeth 22*a*, 22*b*, 22*c*, etc. has an upwardly and inwardly inclined upper edge 24*a*, 24*b*, 24*c*, which are adapted to engage a downwardly facing annular shoulder C2 of the terminal connector fishing ring Cl so as to grip the connector C between the gripping fingers 14*a*, 14*b*, 14*c*, as the fishing tool F and the electrical cable are retrieved from the well.

Preferably, the truncated bore 12*b* of the main body 12 extends longitudinally sufficiently to permit the male type electrical cable terminal connector to be received and gripped. Additionally, openings 12*f* are preferably provided in the main body 12 which communicate with the truncated bore 12*b* to permit the passage of well fluids therethrough as the fishing tool F is lowered in a well containing same. Similarly, openings 18*h* are preferably provided in the outer tubular body 18 to permit such passage of fluids, particularly as the electrical cable terminal connector C is being received in the space 16 between the gripping fingers 14*a*, 14*b*, 14*c*, etc. As illustrated in the drawings, the openings 12*f* are positioned adjacent the upper end of the truncated bore 12*b* of the main body 12 while the openings 18*h* are positioned adjacent the annular beveled portion 18*f* of the outer tubular body 18.

Preferably, the main body 12 and plurality of flexible grippings fingers 14*a*, 14*b*, 14*c*, etc. are integrally formed from a suitable metal with the fingers having thinner cross-sections which will permit them to flex with sufficient spring pressure to retain the terminal connector C therebetween upon receiving and gripping same. Further, the outer tubular body inner wall 18*a* preferably provides an inner cross-sectional diameter so as to cause the inward positioning of the gripping fingers 14*a*, 14*b*, 14*c* etc. at least substantially parallel relative to each other and with the longitudinal axis of the main body 12 when the outer tubular body 18 is longitudinally moved to the aforementioned position about the fingers.

OPERATION

In operation, the fishing tool F is connected with the wireline W at its upper end 12*c* employing any conventional connection means for fixedly contacting the main body 12 with the wireline W. Before inserting the fishing tool F into the well bore or well pipe in which the electrical cable is disposed, the outer tubular body is longitudinally moved to the position concentrically about the gripping fingers 14*a*, 14*b*, 14*c*, etc. whereby the outer tubular body inner wall 18*a* contacts the gripping fingers 14*a*, 14*b*, 14*c* etc. and moves them inwardly relative to each other under spring pressure to a position where they are substantially parallel relative to each other. During such movement, the outer tubular body is threadably connected with the main body 12 by manual rotation of the outer body 18 relative to the main body 12 providing threadable engagement of the respective annular thread portions 18*d* and 12*d*, as illustrated in FIG. 1.

The fishing tool F may then be inserted into the well and lowered at a desired rate until it comes into contact with the electrical cable terminal connector C. The outer tubular body lower lip 18*g* assists in positioning the terminal connector C in somewhat axial alignment with the main body longitudinal axis for receipt in the space 19 and bore 12*a* and engagement with the inwardly facing gripping finger teeth 22*a*, 22*b*, 22*c*, etc. Upon such engagement, the downward driving force and tool weight causes the flexible gripping fingers to bend outwardly relative to each other within the annular space 19 between them and the outer tubular body enlarged counterbore 18*b* until the terminal connector fishing ring Cl can pass between the gripping finger teeth 21*a*, 21*b*, 21*c* with the terminal connector C being received in the main body bore 12*b* and gripping finger bore space 16. Upon such passage, the outward forced bending of the gripping fingers 14*a*, 14*b*, 14*c* permits the teeth 22*a*, 22*b*, 22*c* to spring inwardly relative to each other to contact the terminal connector C below the annular fishing ring Cl. The fishing tool F continues to pass downwardly with the terminal connector C being further inserted within the space 16 and main body bore 12 until the outer tubular body lower end 18*i* contacts upwardly facing shoulders C3 of outwardly projecting anchor lugs C4 provided on the connector C below the annular fishing ring Cl (FIG. 2). This may be readily determined by the operator at the surface by observance of slacking in the wireline W. The electrical cable, having its terminal connector C gripped by the gripping fingers 14*a*, 14*b*, 14*c*, may then be readily retrieved to the surface by reeling the wireline W.

When the electrical cable C has been retrieved, its terminal connector C may be readily removed from the fishing tool F by manually rotating the outer tubular body 18 relative to the main body 12 to disengage the threads 18*d* and 12*d* and moving the body 18 upwardly longitudinally relative to the body 12. Such upward movement releases the forced inward positioning of the gripping fingers 14*a*, 14*b*, 14*c* and permits them to flare outwardly to their normal unloaded position thereby releasing their gripping force on the terminal connector C, as illustrated in FIG. 3. In the illustrated normal flared position, the gripping finger teeth 22*a*, 22*b*, 22*c*, etc. are positioned outwardly of the cable connector annular fishing ring Cl so as to permit the terminal connector to be slipped outwardly therefrom.

The foregoing disclosure and description of the invention are illustrative and explanatory thereof, and various changes in the size, shape and materials as well as in the details of the illustrated construction may be made without departing from the spirit of the invention.

We claim:

1. A fishing tool for retrieveing from a well sections of electrical cable having terminal connectors at the ends of each section, comprising:

a main body adapted to be supported in a well and having bore means for receiving a terminal connector of the electrical cable section in a well;

a plurality of flexible gripping fingers mounted with the body for gripping the electrical cable terminal connector with a portion of the terminal connector being received in the bore means;

releasable means for restraining the plurality of flexible gripping fingers under spring pressure for gripping said terminal connector and for releasing said spring pressure from said plurality of flexible gripping fingers for releasing the terminal connector from said fingers;

the releasable finger restraining means including an outer tubular body mounted about the main body for longitudinal movement relative thereto between a position about the flexible gripping fingers for retaining said flexible gripping fingers under spring pressure inwardly relative to each other for gripping the electrical cable terminal connector and a position above said flexible gripping fingers for releasing said fingers for movement outwardly relative to each other for releasing the terminal connector; and the outer tubular body including an enlarged counterbore portion forming a space between the outer tubular body and a portion of the plurality of gripping fingers with the outer tubular body positioned about the gripping fingers for limited outward bending of the finger portions to permit the electrical cable terminal connector to pass therebetween upon engagement of the terminal connector with the gripping finger ends with the terminal connector being received between said gripping fingers.

2. The apparatus of claim 1, including:

connector means for connecting said outer tubular body with the main body when said outer tubular body is positioned in the position about the flexible gripping fingers.

3. The apparatus of claim 1, wherein:

the plurality of flexible gripping fingers are integrally mounted at one end of the main body and flare longitudinally outwardly therefrom in spaced circumferential relationship with each other for spring pressured inward and outward movement relative to each other and to the longitudinal axis of the main body.

4. The apparatus of claim 3, wherein the plurality of gripping fingers includes:

an equal plurality of inwardly and upwardly facing teeth for gripping and retaining said terminal connector received between said gripping fingers.

5. The apparatus of claim 4, wherein the plurality of inwardly and upwardly facing teeth releasably engage a lower surface of an outwardly extending annular ring provided with the terminal connector with the terminal connector being received between said gripping fingers.

6. The apparatus of claim 3, wherein:

said outer tubular body having an inner wall of a cross-sectional size slightly greater than the outer cross-sectional size of the main body for engaging the plurality of flared flexible gripping fingers forcing said fingers inwardly relative to each other and the main body longitudinal axis under spring pressure with the outer tubular body positioned about said gripping fingers.

7. The apparatus of claim 6, including:

connector means for releasably connecting said outer tubular body with the main body when said outer tubular body is positioned about the flexible gripping fingers; and stop means for limiting the longitudinal movement of the outer tubular body relative to the main body with said outer tubular body being moved to the position above the flexible gripping fingers.

8. A fishing tool for retrieving from a well sections of electrical cable having terminal connectors at the ends of each section, comprising:

a main body adapted to be supported in a well and having bore means for receiving a terminal connector of the electrical cable section in a well;

a plurality of flexible gripping fingers mounted with the body for gripping the electrical cable terminal connector with a portion of the terminal connector being received in the bore means;

releasable means for restraining the plurality of flexible gripping fingers under spring pressure for gripping said terminal connector and for releasing said spring pressure from said plurality of flexible gripping fingers for releasing the terminal connector from said fingers;

the plurality of flexible gripping fingers are integrally mounted at one end of the main body and flare longitudinally outwardly therefrom in spaced circumferential relationship with each other for spring pressured inward and outward movement relative to each other and to the longitudinal axis of the main body;

the releasable finger restraining means including an outer tubular body mounted about the main body for longitudinal movement relative thereto between a position about the flexible gripping fingers and a position longitudinally above said gripping fingers, said outer tubular body having an inner wall of a cross-sectional size slightly greater than the outer cross-sectional size of the main body for engaging the plurality of flared flexible gripping fingers forcing said fingers inwardly relative to each other and the main body longitudinal axis under spring pressure with the outer tubular body positioned about said gripping fingers; and the outer tubular body is provided with an enlarged counterbore portion having a cross-sectional size greater than the outer tubular body inner wall cross-sectional size and forming a space between the outer tubular body counterbore portion and a portion of the plurality of gripping fingers having the plurality of inwardly and upwardly facing teeth mounted on the ends thereof with the outer tubular body positioned about the gripping fingers for limited outward bending of the finger portions to permit the electrical cable terminal connector to pass therebetween upon engagement of the terminal connector with the inwardly and upwardly facing teeth.

9. The apparatus of claim 8, wherein the outer tubular body has at least one opening communicating with the enlarged counterbore portion and the main body has at least one opening communicating with the bore means, said openings being provided respectively to permit any well fluids collected in the bore means to be forced outwardly therefrom with the electrical cable terminal connector being received between said gripping fingers and the bore means.

* * * * *